United States Patent [19]

Gamble

[11] Patent Number: 4,504,993

[45] Date of Patent: Mar. 19, 1985

[54] SKIER'S ACCESSORY TOOL

[76] Inventor: Christopher L. Gamble, 2040 E. Howe, Tempe, Ariz. 85281

[21] Appl. No.: 480,758

[22] Filed: Mar. 31, 1983

[51] Int. Cl.[3] ..... B25F 1/04

[52] U.S. Cl. ..... 7/165; 7/168; 280/816; D3/62; D3/64; D3/65

[58] Field of Search ..... 7/165, 167, 168, 170; 280/816; D8/82, 38, 87, 105; D3/62, 64, 65, 66, 44; 15/236 R

[56] References Cited

U.S. PATENT DOCUMENTS

| | | | |
|---|---|---|---|
| D. 163,296 | 5/1951 | Lama | D3/65 |
| D. 172,726 | 7/1954 | Polk | D8/99 |
| D. 223,133 | 3/1972 | Olt | D8/87 |
| 2,896,290 | 7/1959 | Salm et al. | D3/64 |
| 3,364,508 | 1/1968 | Garrett | 7/165 |
| 3,816,863 | 6/1974 | Thielemann | 7/165 |

*Primary Examiner*—Roscoe V. Parker

*Attorney, Agent, or Firm*—Gregory J. Nelson

[57] ABSTRACT

A skier's accessory tool including a body in the general configuration of a ski boot having a rear, top, front and sole portion. A first recess is provided in the sole portion and Phillips-type screwdriver is pivotally mounted in the recess and received therein in a closed position. A second recess extends along the top and front of the boot. A second blade is pivotally received in this recess in the closed position. The second blade may be folded out and includes a U-shaped portion for engaging buckles. The outer end of the blade is configured as a flat screwdriver. A section of the blade may also form an ice scraping edge.

5 Claims, 5 Drawing Figures

SKIER'S ACCESSORY TOOL

The present invention relates to a skier's tool and more particularly to a multi-purpose tool for skier's which will assist with adjusting and tightening bindings and release settings, removing snow from equipment and to assist with opening ski boot buckles.

Over the last fifty years the sport of skiing, both alpine and cross-country, has grown substantially. At the time of the 1932 Winter Olympics, there were very limited areas for sport skiing in the United States. The 1932 Winter Olympics in Lake Placid is often credited as the event which brought the attention of the American public to skiing. Ever since that time, the ski industry has grown almost continually. According to more recent, studies, over nineteen million people in the United States participate in skiing and it is now one of the leading participant sports.

With the growth of skiing, substantial improvements and developments have taken place in the area of equipment. Ski boots utilized today are of a substantial advance over the leather lace-type boots of the past. The contemporary boot generally has a shell of light-weight polymeric material. The boot closures generally consist of a buckle portion and a bail which cooperates with the buckle. The buckle generally has multiple settings or is adjustable to the desired tightness. In cold weather it is sometimes difficult, particularly for the younger beginning skier, to loosen the ski boot buckles.

Similarly, significant advances have been made in bindings. Generally ski bindings consist of a toe piece and a heel piece which cooperate with the boot. The bindings have multi-directional release mechanism to protect the skier. Generally, the bindings are affixed to the ski by screws. The release settings are similarly adjustable by screws. If a problem arises on the slopes, the skier is generally not equipped to make these adjustments.

Another problem often encountered by skiers is accumulation of packed snow and ice on boot surfaces and bindings which prevent the proper locking and operation of the bindings. Such a build-up can present a hazardous condition. Most skiers prior to stepping into bindings will attempt to remove any ice or snow from the bottom of their boots by simply striking the sole of the boot with a ski pole or other implement. This is not satisfactory and further is often a tricky maneuver performed while the skier is standing on one foot on snow or ice.

It will be obvious from the foregoing that there exists a need for a self-contained, multi-purpose ski accessory tool which can perform various functions including providing the skier with the ability to adjust and secure bindings, scrape snow from ski equipment surfaces and also assist the skier with opening of boot buckles and closures. In order to accomplish this now, the skier must carry several screw drivers, generally one Phillips and one flat head, for binding adjustments. Since this is not practical, most skiers, in the event an adjustment is necessary, must return to the lodge to accomplish this adjustment. Also, as pointed out above, removal of snow from boot and binding surfaces is also a problem. A few tools have been provided particularly suggested for ski use, but these are generally single purpose tools and are either unwieldy, bulky or serve only a single purpose so they have not found general acceptance with skiers. As pointed out above, most skiers end up having to return to the lodge and find a ski shop to make necessary adjustments and repairs.

Accordingly, there exists a need in the art for a self-contained and integrated multi-purpose ski tool which will provide the skier with the tools necessary to make binding adjustments and further will assist the skier with snow removal and opening of ski buckles.

Briefly, the present invention provides a multi-purpose ski tool having a body or housing generally in the shape of a ski boot. A first screwdriver blade having a Phillips head is pivotally mounted within the boot-shaped housing and in a closed condition folds into a recess at the sole of the boot. A second blade which has a U-shaped latch hook at its outer end also is pivotally secured to the boot-shaped housing and in a closed position folds into a recess along the front of the housing. The end of the latch hook has a conventional flat screwdriver blade. A scraper edge may also be formed along the bight portion of the hook. In one form of the invention, a portion of the rear of the housing opens to provide access to an internal compartment for carrying various items such as screws or other repair parts.

The above and other objects and advantages of the present invention will be better understood from the following description, claims and drawings in which:

Figure 1:
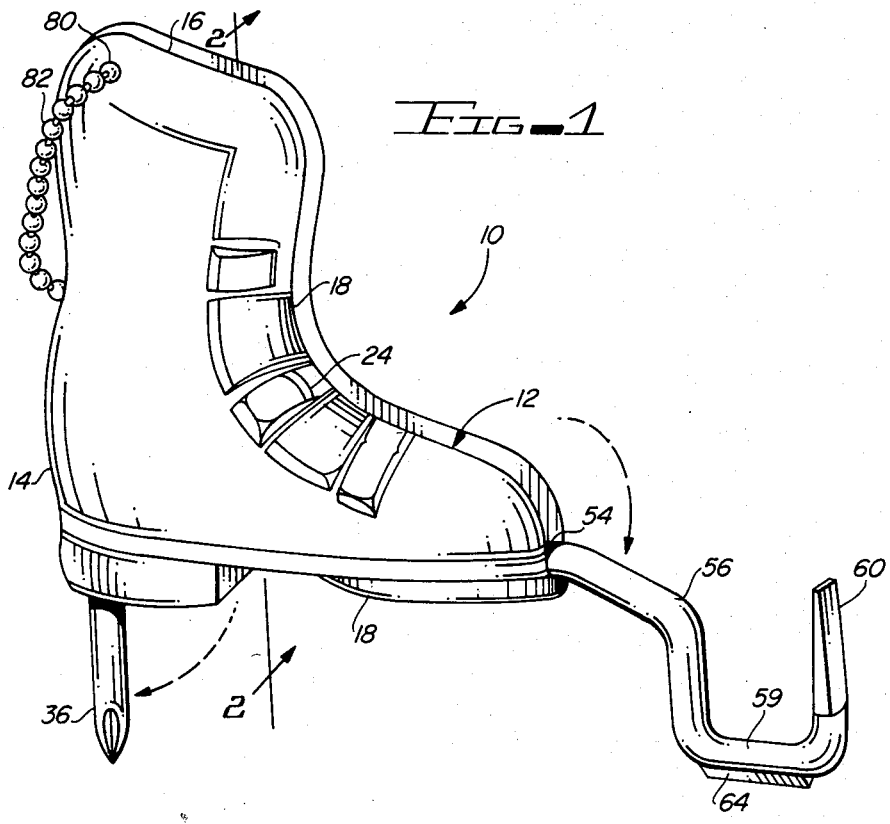
FIG. 1 is a perspective view of the ski tool of the present invention shown with both blades in an open position.

Turning now to the drawings, the ski tool of the present invention is generally designated by the numeral 10 and includes a housing 12 which is generally configured in the shape of a conventional ski boot having a rear surface 14, top 16, front surface 18 and bottom or sole portion 20. The body or housing 12 can be fabricated from any suitable material and preferably is injection molded from a polymeric material such as a vinyl polyethylene or the like colored for high visibility in snow conditions. The outer surface of the body is provided with raised portions 24 in the form of representations of ski buckles to further give the appearance of a ski boot.

A recess 30 is provided in the sole 20 of the housing. Recess 30 has an enlarged semi-circular portion 32 in the heel area. A pivot pin 34 integrally formed as a part of the housing, extends transversely in recess portion 32. A tool shown as a screwdriver 36 is pivotally received within recess 30. Screwdriver 36 consists of a shank portion 38 terminating at a head 40 configured to be used with Phillips head screws. The opposite end of shank 38 is formed in a circular portion 42 about pivot pin 34. Therefore, the screwdriver can be rotated from the closed position shown in FIG. 2 to the extended position shown in FIG. 1 for use. In the closed position, the entire tool is in an out-of-the-way position within the body or housing.

Figure 3:
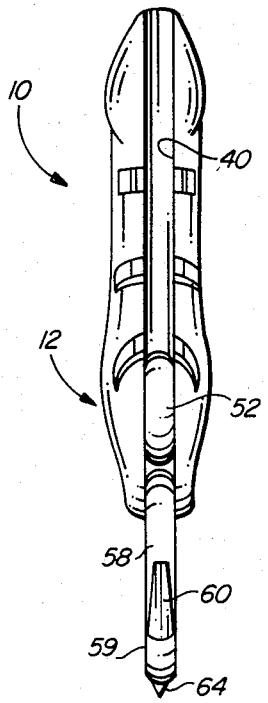
FIG. 3 is a front view of the tool shown in an open position.
Figure 2:
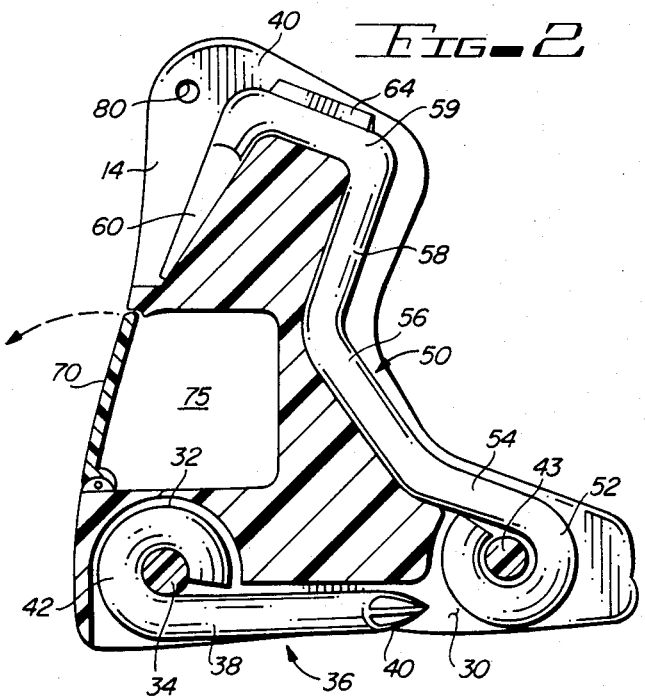
FIG. 2 is a sectional view taken along lines 2—2 of FIG. 1 shown with both blades in a closed position.
Figure 4:
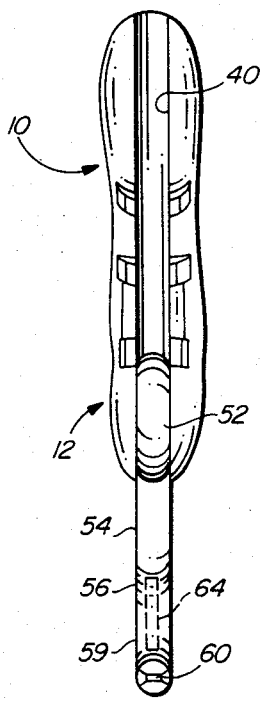
FIG. 4 is a top view of the tool shown in an open position.
Figure 5:
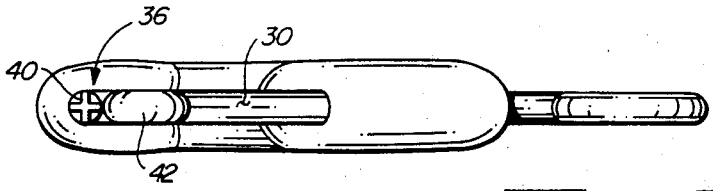
FIG. 5 is a bottom view of the ski tool shown in an open position.

Another recess 40 extends along the vertical centerline of the housing at the top of the back edge 14 of the boot, along the top edge 16 of the housing and along the front edge 18 of the housing. Recess 40 is symmetrical with respect to the housing as best seen in FIGS. 3 and 4. A pivot pin 43 extends transversely within the recess 40 at the toe of the housing. A second tool 50 is received within recess 40 in the closed position as best seen in FIG. 2. The tool 50 includes a generally circular end 52 which is pivotal about pin 43. The tool has a first shank portion 54, a second shank portion 56 which forms an obtuse angle with respect to shank portion 54. A third shank portion 58 is in a general U-shape secured at the end of shank portion 56. The U-shaped hook has a bight portion 59 and terminates at a blade 60. Blade 60 is shown as a conventional wedgeshaped tool having opposite flat sides for use with conventional slotted screws. The bight portion 58 of the U-shaped hook is provided with a scraper edge 64 on its outer surface which is useful in scraping or removing snow from ski equipment.

The tool 50 in the extended position assumes the position as best seen in FIG. 1, extending generally forwardly from the toe portion of the housing. In this position, the U-shaped hook 59 faces upwardly as shown in FIG. 1.

The various tool blades 20 and 50 may be made of a suitable high-quality tool steel and may be suitably plated for durability and improved appearance.

In addition to the foregoing, a pivotal cover 70 is integrally formed as part of the lower rear portion of the boot pivoting about pin 72. With cover 70 in the open position, internal compartment 75 within the housing or body is accessible. Compartment 75 is available for storage of additional useful items such as small screws or the like which may be needed in making a temporary repair to a ski binding while on the slopes.

To further improve the convenience of the device, a transverse bore 80 may be provided in the upper edge of the housing to receive a suitable chain 82 shown as a bead chain which may be attached to a belt loop or other part of the clothing of the user.

The device or tool when not in use, has the general outward appearance of a ski boot which enhances its attractiveness to skiers and also serves as a reminder to skiers that the tool should be carried when skiing. The tools 20 and 50 are retained within the body in a safe position and in a closed condition. In the event the user wishes to open a ski boot buckle, the blade 50 can be opened forwardly in the position shown in FIG. 1. The upwardly facing hook can be engaged about the ski buckle and the user can grasp the body of the tool and exert substantial leverage to open the resisting buckle. This saves the skier from possible injury to the fingers, particularly in cold weather. The scraper edge 64 is also available in the open position to remove snow or ice from the bottom of the ski boot or the surface of the ski binding. Adjustments to ski binding settings can be accomplished by use of the screwdriver tip 60.

In the event a Phillips head screw is encountered, the blade 36 can be extended to the position shown in FIG. 1 and is available for loosening or tightening this type of screw. Note that in the relationship of the housing, both the blades are selected so that substantial mechanical leverage is available. The user can grasp the body in several different ways with the selected blade extending between the fingers of the user. In this way there is a substantial handle portion of the tool to be grasped to prevent slipping and twisting.

It will be seen from the foregoing that the present invention provides a unique, highly attractive and efficient tool for skiers. The tool is multi-purpose serving a number of functions. Further, the device is attractive and, along with its unique appearance, provides substantial functional advantages.

It will be obvious to those skilled in the art to make various changes, alterations and modifications to the skier's tool of the present invention. To the extent these changes, alterations and modifications do not depart from the spirit and scope of the appended claims, they are intended to be encompassed therein.

I claim:

1. A skier's accessory tool comprising:

(a) a body defining first and second recesses, said body being in the general configuration of a ski boot having a top edge, rear edge, front edge and sole, said first recess provided along a portion of the body corresponding to the sole of the body and said second recess provided in an area of the body generally extending along the front and top of the body;

(b) a first tool pivotally secured at said first recess having an end configured in a first tool shape; and (c) a second tool pivotally secured at said second recess adapted to be moved to an open position extending from said recess, said second tool having an end configured in a second tool shape and having a generally hook-shaped portion.

2. A skier's accessory tool comprising:

(a) a body in the general configuration of a ski boot having a top edge, a rear edge, a front edge and sole, said body defining a first recess along a portion and generally corresponding to the sole of the body and defining a second recess in an area of the body generally extending along the front and top of the body;

(b) a first tool pivotally secured in said first recess having an outer end configured in a first tool shape;

(c) a second tool pivotally secured in said second recess adapted to be moved to an open position extending from said second recess, said second tool having an outer end configured in a second tool shape;

(d) one of said tool shapes being configured to cooperate with Phillips-type screws and the other of said tool shapes being configured having opposite, generally flat faces;

(e) said second tool including a generally hook-shaped portion having a bight, said hook-shaped portion adapted to engage the buckle of a conventional ski boot whereby said second tool may be used to assist in the opening of ski boot buckles.

3. The tool of claim 2 wherein said bight portion is provided with a scraper edge adapted to remove snow from ski equipment.

4. The tool of claim 3 wherein said housing defines an internal compartment.

5. The tool of claim 2 wherein said body is fabricated of plastic and is a high visibility color.

* * * * *